US010144549B2

(12) United States Patent
Manella

(10) Patent No.: US 10,144,549 B2
(45) Date of Patent: Dec. 4, 2018

(54) CONTAINER FOR SHIPPING AND DISPLAYING PRODUCTS

(71) Applicant: Sonoco Development, Inc., Hartsville, SC (US)

(72) Inventor: Robert Scott Manella, Batavia, IL (US)

(73) Assignee: Sonoco Development, Inc., Hartsville, SC (US)

( * ) Notice: Subject to any disclaimer, the term of this patent is extended or adjusted under 35 U.S.C. 154(b) by 245 days.

(21) Appl. No.: 15/079,165

(22) Filed: Mar. 24, 2016

(65) Prior Publication Data

US 2017/0275046 A1 Sep. 28, 2017

(51) Int. Cl.
*B65D 5/52* (2006.01)
*B65D 5/20* (2006.01)
*B65D 5/64* (2006.01)

(52) U.S. Cl.
CPC ..... *B65D 5/52* (2013.01); *B65D 5/20* (2013.01); *B65D 5/5226* (2013.01); *B65D 5/64* (2013.01)

(58) Field of Classification Search
CPC ..... B65D 5/52; B65D 5/5206; B65D 5/20; B65D 5/64
USPC ..... 206/386, 503, 508, 557, 595, 596, 597, 206/598, 599, 600, 730, 732, 735, 736, 206/752, 767, 831, 45.2, 45.21, 45.247, 206/45.25, 45.28, 45.29, 768; 229/125, 229/125.28, 915
See application file for complete search history.

(56) References Cited

U.S. PATENT DOCUMENTS 4,191,288 A * 3/1980 Hostad ..... B65D 5/5206 206/764
4,411,382 A 10/1983 Taub
6,557,708 B2 * 5/2003 Polacco ..... B65D 77/042 206/599
6,942,102 B2 9/2005 Justice
7,066,333 B2 6/2006 Justice
8,573,401 B2 * 11/2013 Taneda ..... B65D 5/445 108/53.1
2009/0250375 A1 * 10/2009 Ecker ..... B65D 5/5246 206/736

* cited by examiner

*Primary Examiner* — Steven A. Reynolds
*Assistant Examiner* — Javier A Pagan
(74) *Attorney, Agent, or Firm* — Miller, Matthias & Hull LLP

(57) ABSTRACT

A container that can function both as a shipper and as a retail display is provided. The container comprises a tray and a lid. Upon delivery to the retail site, the lid can be removed and used as a display base. The tray is mounted to the lid and secured thereto with locking tabs.

12 Claims, 3 Drawing Sheets

CONTAINER FOR SHIPPING AND DISPLAYING PRODUCTS

BACKGROUND OF THE INVENTION

Field of the Invention

This disclosure relates to packaging. More particularly, this disclosure relates to a two piece container comprising a base and a tray that can function both as shipper and as a retail display in which the tray is mounted to the base.

Description of the Related Art

Containers that function as both shippers and retail displays are known. For example, U.S. Pat. No. 7,066,342, owned by Sonoco Development, Inc., discloses a modular packaging system comprising posts and trays that can be used to both ship and display retails goods.

U.S. Pat. No. 4,411,382 discloses an erectable display comprising a floor base and a display tray. The base is collapsible and fits inside the tray during shipping.

U.S. Pat. No. 6,942,102 discloses a shipper comprising a base and a lid. After the lid is removed the base functions as a display.

U.S. Pat. No. 7,066,333 discloses a shipping container comprising a base and a lid. After the lid is removed the base can be used as a retail display.

A need exists for a container comprising a tray and a lid, wherein the container can function both as a shipper and as a retail display in which the lid can function as a base and the tray can be mounted to and elevated by the lid/base. The container described herein is designed to meet this need.

BRIEF SUMMARY OF THE INVENTION

The present disclosure relates to a container that can function both as a shipper and also as a retail display. The container comprises a tray and a lid. The lid also functions as a display base. Upon delivery to the retail site, this lid is removed and the tray can be mounted to and elevated by the lid/base.

In one embodiment the tray comprises a bottom panel, two side panels, a front panel, a back panel and at least one locking tab. The lid comprises a top 40, two side panels, a front panel and a rear panel. The top defines at least one slot. The container can be reconfigured from a box-like shipper configuration in which the lid covers the tray side panels, the tray front panel and the tray back panel but not the tray bottom panel, to a retail display configuration in which the tray rests on the lid and in which the locking tab(s) is/are inserted into the slot(s) to secure the tray to the lid. In the display configuration, the tray bottom panel rests on the lid top and is coextensive therewith.

The container may also comprise a foldable header affixed to the back panel along a back panel top edge. The header extends from the back panel to a free edge. The header may be folded over so that its free edge can be inserted into a die cut located in the tray back panel.

In one refinement the lid top defines a side slot adjacent each of its side edges and the tray comprises two side locking tabs. Each side locking tab is configured to fit through a corresponding side slot in the lid top when the container is in the display configuration.

In another refinement the top defines a front slot adjacent a front edge and the tray front panel comprises a front locking tab hingedly attached to an inner front panel and configured to fit through the front slot when the container is in the display configuration.

In another aspect the disclosure relates to a blank used to make a tray such as the tray described above. The blank comprises a bottom panel, a back panel, a first header panel, a second header panel, two inner side panels, two outer side panels, two middle side panels, an outer front panel, an inner front panel and side locking tabs.

The bottom panel has a rectangular perimeter comprising a front edge, opposing side edges and a rear edge. The bottom panel defines a front slot adjacent the front edge and a pair of slide slots adjacent the side edges.

The back panel is hingedly attached to the bottom panel along the bottom panel rear edge. The back panel has a top edge and opposing side edges and includes an upwardly facing tab defined by a die cut.

Each side outer panel is hingedly attached to the bottom panel along one of the bottom panel side edges. Each side outer panel has a perimeter comprising a bottom edge coinciding with a bottom panel side edge, a rear edge, a slanted top edge and a front edge.

Each side inner panel is hingedly attached to a corresponding side outer panel along the slanted top edge. Each side inner panel has a perimeter comprising the slanted top edge, a free bottom edge, a rear edge and a front edge parallel to but shorter than the rear edge.

Each side middle panel is hingedly attached to the back panel along a back panel side edge. Each side middle panel has a perimeter comprising the back panel side edge, a front edge parallel to but shorter than the back panel side edge, and a bottom edge.

The outer front panel is connected to the bottom panel along a front fold line. The inner front panel is connected to the outer front panel along a front panel fold line.

Each side locking tab is hingedly attached to an inner side panel free bottom edge.

The front locking tab is hingedly attached to the inner front panel.

In a refinement a header is hingedly attached to and extends from the back panel along the back panel top edge.

In another aspect the disclosure relates to a method of assembling a retail display from a shipping container such as the one described above. The method comprises the steps of:

lifting the lid off of the tray and standing the lid on a flat surface with the top facing up;

placing the tray onto the top of the lid; and inserting the locking tab(s) into the corresponding slot(s).

In a refinement the method comprises the additional step of:

raising the header into position and inserting the free edge of the header into the curved die cut located in the tray rear wall.

DETAILED DESCRIPTION OF THE INVENTION

Figure 1:
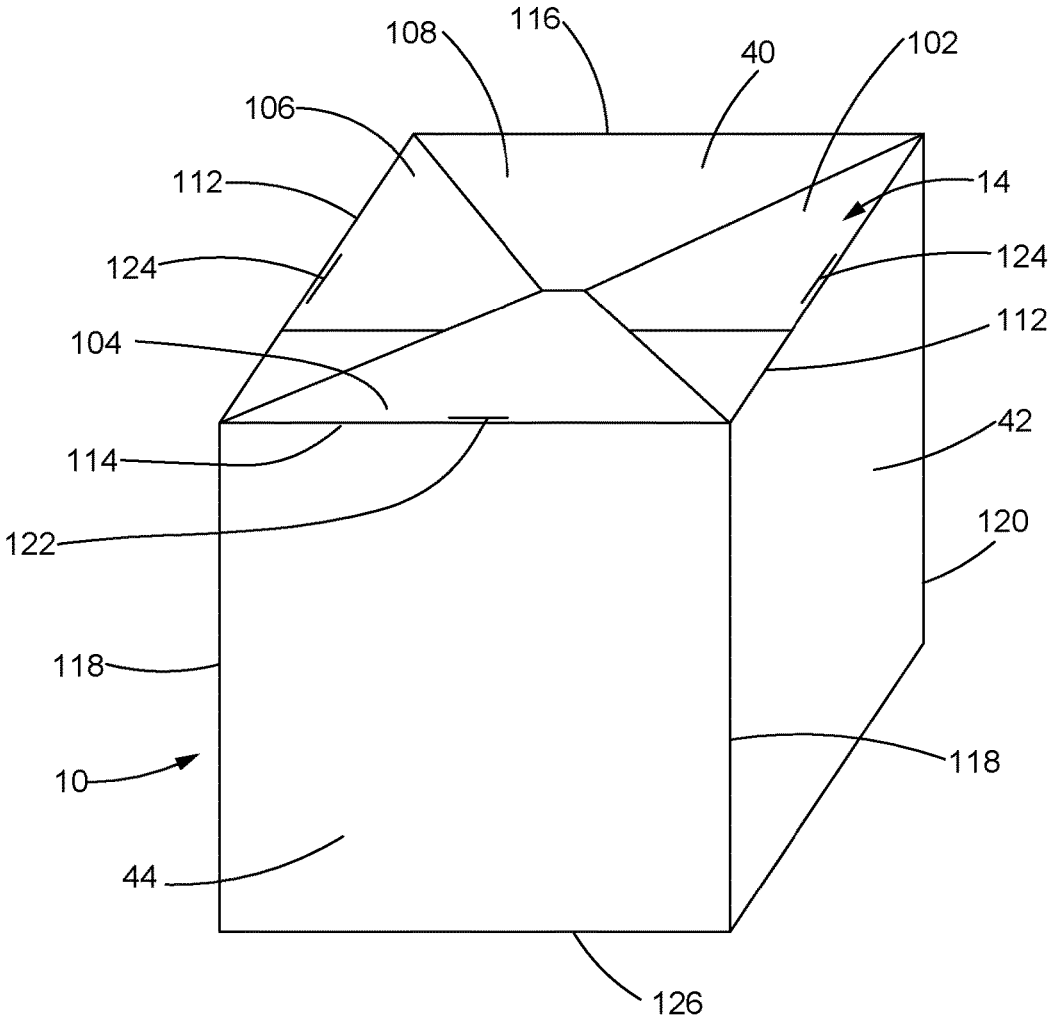
FIG. 1 is perspective view of a shipping container comprising a tray and base according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "upper" and "lower", "top" and "bottom," "front" and "back," (etc.), used as nouns, adjectives or adverbs refer in this description to the orientation of the structure of the container as it is illustrated in the various figures. For example, "upward" generally refers to the direction towards the top of the page in FIG. 2 and "forward" generally refers to the direction towards the viewer in FIG. 2. Such terms are not intended to limit the invention to a particular orientation.

Turning to the drawings, where like numerals indicate like elements, there is shown one embodiment of a container 10 that can function as a shipper and can be reconfigured to also function as a retail display.

FIG. 1 is perspective view of the container 10. Although the container comprises a tray 12 and a lid/base 14, only the lid 14 can be seen in this view. The tray 12 is covered by the lid 14. The lid 14 covers and protects the tray 12 during shipping. The lid/base 14 can be any suitable dimensions, and generally is slightly larger than the tray so that the lid 14 slides easily over the tray 12.

The lid 14 comprises a top 40, two side panels 42, a front panel 44 and a rear panel 46 (obscured in FIG. 1). The top 40 may be formed from multiple top flaps 102, 104, 106 and 108 folded inwardly as explained in reference to FIG. 4 below. The lid 14 has a bottom rim 126 upon which it can rest when used as part of a display.

Figure 2:
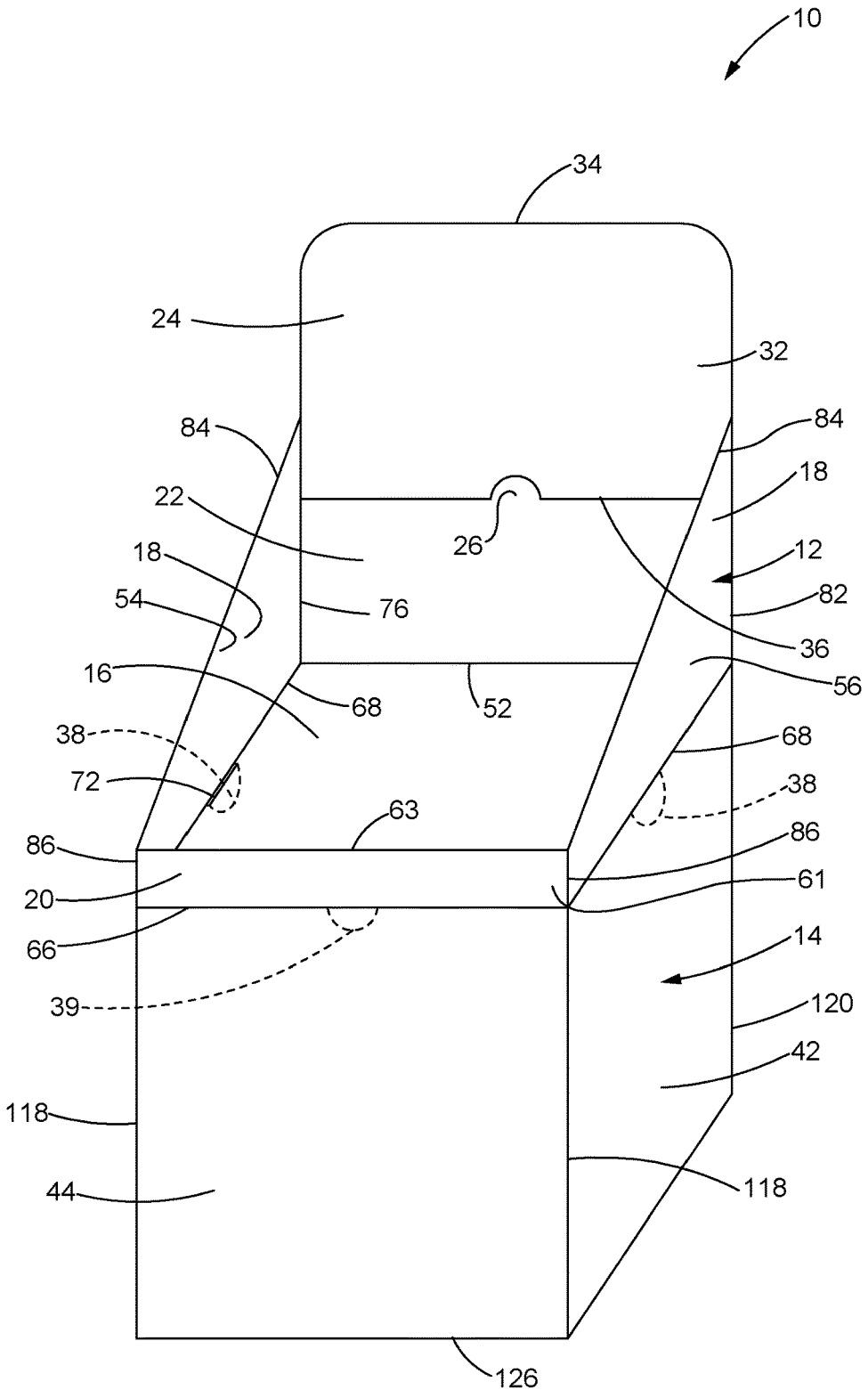
FIG. 2 is perspective view of the container of FIG. 1 after the base has been removed and used as a pedestal for the tray.

FIG. 2 is perspective view of the container 10 of FIG. 1 after the lid 14 has been lifted from the tray 12 and used as a base 14 for the tray 12. The tray 12 is mounted to the base 14 as explained below. The tray 12 comprises a rectangular bottom panel 16, double or triple wall thickness side panels 18, a front panel 20, a back panel 22 and a header 24 that extends upwardly from and is affixed to the back panel 22.

Each side panel 18 has a trapezoidal shape and extends from a front edge 86 to a relatively longer rear edge 82 and from a bottom edge 68 to a slanted top edge 84. Each side panel 18 comprises a side middle panel 58 (obscured in FIG. 2) sandwiched between a side outer panel 56 and a side inner panel 54.

The front panel 20 has an elongated rectangular shape and extends upwardly from a front edge 66 to a top edge or fold line 63 and laterally from one side panel front edge 86 to an opposite side panel front edge 86. The front panel 20 comprises an outer front panel 61 connected to the tray bottom panel 16 along a front fold line 66 and an inner front panel 62 (obscured in FIG. 2) connected to the outer front panel 61 along a front panel fold line 63. The side panels 18 have locking tabs 64 that extend laterally inward from each side outer panel 56 and are secured between the outer and inner front panels 61, 62.

In the illustrated embodiment the back panel 22 is rectangular extends upwardly from a rear edge 52 of the tray bottom panel 16 to a back panel top edge 74 (obscured by the second header panel 32 in FIG. 2) and laterally from one side edge 76 to an opposite side edge 76. The back panel 22 includes an upwardly facing tab 26 defined by a curved die cut 28. The side middle panels 58 referred to above are attached to the back panel 22 along vertical fold lines 76 coinciding with the back panel side edges 76.

Figure 3:
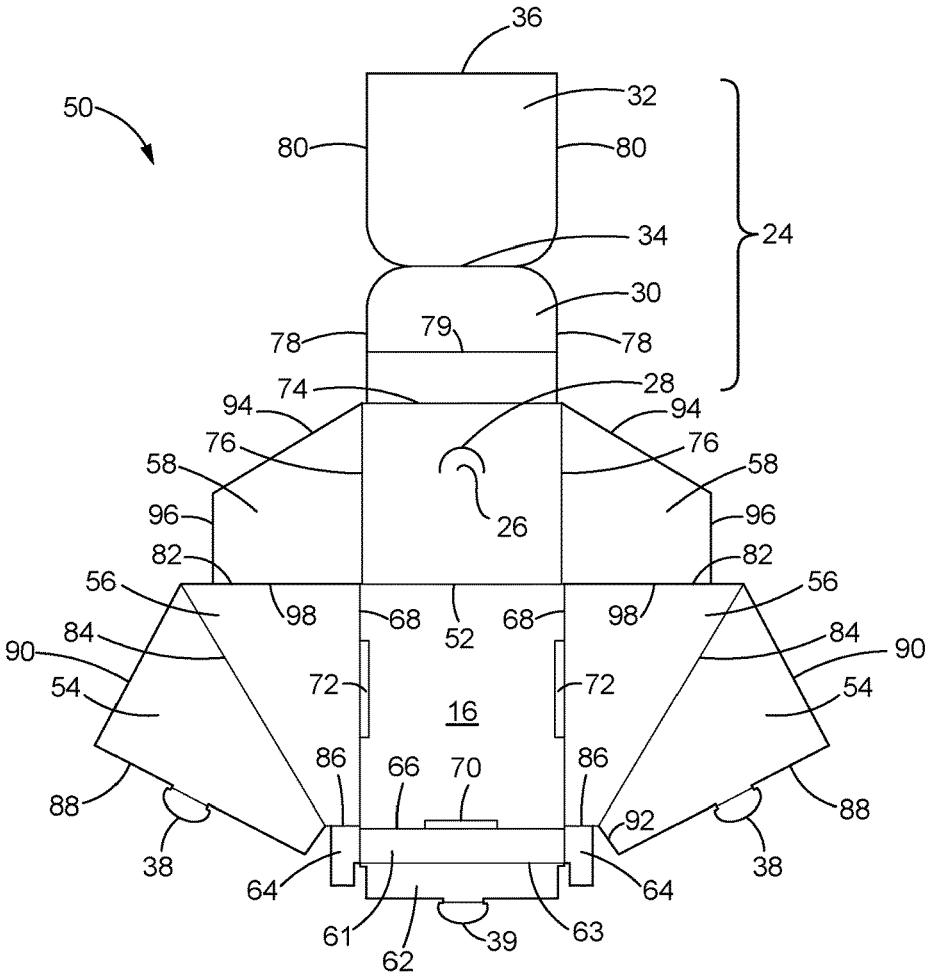
FIG. 3 is a plan view of a blank used to make the tray of FIG. 2.

The header 24 comprises a first header panel 30 and a second header panel 32 hingedly connected by a fold line 34 so that the second header panel 32 can be folded over in front of the first header panel 30 until a free edge 36 of the second header panel 32 is secured under the tab 26. The first header panel 30 is best shown in FIG. 3, and extends from the back panel top edge 74 to the fold line 34 and laterally from one side edge 78 to an opposite side edge 78. The first header panel 30 may comprise a horizontal fold line 79 located parallel to and between the back panel top edge 74 and the header fold line 34. This fold line 79 helps facilitate construction of the header 24 as explained below.

In the illustrated embodiment the tray 12 includes a side locking tab 38 hingedly attached to each side inner panel 54 and a front locking tab 39 hingedly attached to the inner front panel 62. These tabs 38, 39 are inserted into slots defined by the base 14 to help secure the tray 12 to the base 14. The tray 12 may hold one or more articles (not shown), such as blister packs, CDs and DVDs.

FIG. 3 is a plan view of a blank 50 used to make the tray 12 of FIG. 2. The blank 50 may be corrugated board, paper board or any suitable material. In the illustrated embodiment, the blank 50 comprises a bottom panel 16, a back panel 22, a first header panel 30, a second header panel 32, two side inner panels 54, two side outer panels 56, two side middle panels 58, an outer front panel 61, an inner front panel 62, side locking tabs 38, a front locking tab 39 and elongated locking tabs 64.

In the illustrated embodiment the bottom panel 16 has a rectangular perimeter comprising a front edge 66, opposing side edges 68 and a rear edge 52. The bottom panel 16 defines a front slot 70 adjacent the front edge 66 and a pair of slide slots 72 adjacent the side edges 68.

The back panel 22 is hingedly attached to the bottom panel 16 along the bottom panel rear edge 52 and has a top edge 74 and opposing side edges 76. As noted above the back panel 22 includes an upwardly facing tab 26 defined by a die cut 28. The die cut 28 may be any suitable shape, including the curved shape shown in the figures.

The first header panel 30 is hingedly attached to the back panel 22 along the back panel top edge 74 and has a top edge 34 coinciding with the header fold line 34 and free, opposing side edges 78. In FIG. 3 the first header panel 30 has a horizontal fold line 79 located parallel to and between the back panel top edge 74 and the header fold line 34.

The second header panel 32 is hingedly attached to the first header panel 30 along the header fold line 34 and has a free edge 36 and free, laterally opposing side edges 80.

Each side outer panel 56 is hingedly attached to the bottom panel 16 along one of the bottom panel side edges 68. Each side outer panel 56 has a perimeter comprising a bottom edge 68 coinciding with a bottom panel side edge 68, a rear edge 82, a slanted top edge 84 and a front edge 86 parallel to but shorter than the rear edge 82. An elongated locking tab 64 extends from the front edge 86.

Each side inner panel 54 is hingedly attached to a corresponding side outer panel 56 along the slanted top edge 84. Each side inner panel 54 has a perimeter comprising the slanted top edge 84, a free bottom edge 88, a rear edge 90 and a front edge 92 parallel to but shorter than the rear edge 90. A side locking tab 38 extends from the bottom edge 88.

Each side middle panel 58 is hingedly attached to the back panel 22 along a back panel side edge 76. Each side middle panel 58 has a perimeter comprising the back panel side edge 76, a slanted top edge 94, a front edge 96 parallel to but shorter than the back panel side edge 76, and a bottom edge 98.

Figure 4:
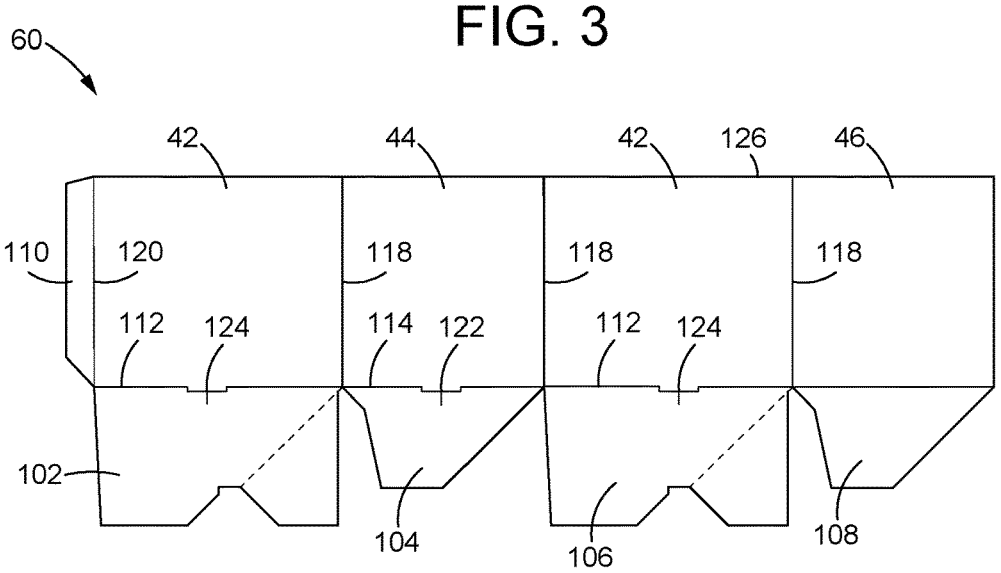
FIG. 4 is a plan view of a blank used to make the base of FIG. 2.

FIG. 4 is a plan view of a blank 60 used to make the lid/base 14 of FIGS. 1 and 2. The blank 60 comprises four major rectangular panels: the front panel 44, the rear panel 46 and the two side panels 42. Together these panels 42, 44, 46 may be thought of as forming the four "sides" of the lid 14. The illustrated blank 60 further comprises irregularly shaped top flaps 102, 104, 106 and 108 that fold inwardly and together form the top 40 of the container 10 of FIG. 1. The side top flap 102 extends from one of the side panels 42 along a fold line 112. The other side top flap 106 extends from the other side panel 42 along a fold line 112. The front top flap 104 extends from the front panel 44 along a fold line 114. The rear top flap 106 extends from the rear panel 46 along a fold line 116. An elongated glue flap 110 extends from a vertical edge 120 of a side panel 42 and is used to secure the side panel 42 to the rear panel 46 as explained below.

Method of Assembling the Tray and Base

The tray 12 is assembled from the blank 50 according to the following steps:

Fold the back panel 22 upward along rear edge 52 until it is vertical and perpendicular to the bottom panel 16.

Fold each side middle panel 58 forward along back panel side edge 76 until the side middle panels are perpendicular to the back panel 22.

Fold the side panels 56 upward along edges 68 until they are vertical and perpendicular to the bottom panel 16. The side outer panels 56 should be flush against the side middle panels 58.

Fold the side inner panels 54 over the side middle panels 58 and insert the locking tabs 38 into the corresponding side slots 72, then fold the locking tabs 38 upward so that they are flush against the tray bottom panel 16.

Fold the locking tabs 64 toward each other along front edges 86 until they are perpendicular to their respective side outer panel 56.

Fold the outer front panel 61 upward along bottom panel front edge 66 until it is vertical and perpendicular to the bottom panel 16. The outer front panel 61 should be flush against the locking tabs 64.

Fold the inner front panel 62 along front panel fold line 63 and over the locking tabs 64 and insert the front locking tab 39 into the corresponding front slot 70, then fold the locking tab 39 upward so that it is flush against the tray bottom panel 16.

Finally, rotate the header panels 30 and 32 forward along horizontal fold line 79 and fold lines 34, 74 until the header 24 is secured in a shipping position in which the base 14 can fit easily over the header 24 and the rest of the tray 12.

The base 14 is assembled from the blank 60 according to the following steps:

Fold the glue flap 110 along vertical fold line 120 until it is perpendicular to the side panel 42 to which it is attached.

Fold the front panel 44, side panels 42 and rear panels 46 along vertical fold lines 118 and affix the glue flap 110 to rear panel 46 to form a cylindrical structure.

Fold the top flaps 102, 104, 106 and 108 inwardly along fold lines 112, 144 and 116 and secure the top flaps 102, 104, 106 and 108 together in a planar configuration to complete the base assembly. Folding the top flaps 102, 104, 106 and 108 opens a front slot 122 adjacent the front edge 114 and a pair of side slots 124, each adjacent a side edge 112.

Once assembled, the tray 12 can be loaded with products and the base 14 can then be placed over the tray 12 to form the container of FIG. 1.

Method of Assembling the Display

Once the container 10 reaches its final destination, such as a retail store, the display can be assembled as follows:

Lift the base 14 off of the tray 12 and stand the base 14 on a flat surface with the top 40 facing up and the front edge 114 facing forward. This basically is the configuration shown in FIG. 1.

Taking the tray 12 in hand, raise the header 24 into position by lifting the second header panel 32 upward and backward and inserting the free edge 36 into the curved die cut 28 and behind the upwardly facing tab 26. During this step the first header panel 30 may rotate backwards along horizontal fold line 79 and the second header panel 32 may rotate forward along fold line 34.

Place the tray 12 onto the top 40 of the base 14, being careful to insert the front locking tab 39 into the front slot 122 and the two side locking tabs 38 into the side slots 124 to complete the assembly of the display. The display should look like that shown in FIG. 2.

INDUSTRIAL APPLICABILITY

The container 10 can function as shipper and as a retail display in which the tray 12 is mounted to the base 14. The base 14 can be any height and can elevate the tray 12 for a more appealing and convenient retail display. The tray 12 also can be used alone as a retail display.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A shipping and display container comprising:

a tray comprising a bottom panel, two side panels, a front panel and a back panel, the tray further comprising at least one locking tab; and a lid comprising a top, two side panels, a front panel and a rear panel, the top defining at least one slot;

the tray back panel extending upwardly from a rear edge of the tray bottom panel to a back panel top edge and laterally from a back panel side edge to an opposite back panel side edge;

the container further comprising a side middle panel hingedly attached to the back panel along each of the back panel side edges;

each tray side panel comprising a side outer panel hingedly attached to a side inner panel along a tray side panel top edge;

each side middle panel being sandwiched between a side outer panel and a side inner panel; wherein the container can be reconfigured from a box-like shipper configuration in which the lid covers the tray side panels, the tray front panel and the tray back panel but not the tray bottom panel, to a retail display configuration in which the tray rests on the lid and in which the at least one locking tab is inserted into the at least one slot to secure the tray to the lid; and wherein, in the display configuration, the tray bottom panel rests on the lid top.

2. The shipping and display container of claim 1 wherein, in the display configuration, the tray bottom panel and the lid top are coextensive.

3. The shipping and display container of claim 1 further comprising:

a foldable header affixed to the tray back panel along a tray back panel top edge, the header extending from the tray back panel to a free edge.

4. The shipping and display container of claim 3 wherein: the tray side panel top edge is slanted.

5. The shipping and display container of claim 3 wherein the foldable header comprises:

a first header panel hingedly attached to the back panel along the back panel top edge, the first header panel having a top edge; and a second header panel hingedly attached to the first header panel along the first header top edge, the second heard panel having a free edge.

6. The shipping and display container of claim 5 wherein: the back panel includes an upwardly facing tab defined by a die cut; and the second header panel free edge is secured under the upwardly facing tab.

7. The shipping and display container of claim 1 wherein: the top extends from a front edge to a rear edge and laterally from one side edge to an opposite side edge;

the top defines a side slot adjacent each side edge; and the tray comprises two side locking tabs, each side locking tab hingedly attached to a side inner panel and configured to fit through a side slot when the container is in the display configuration.

8. The shipping and display container of claim 7 wherein: the top defines a front slot adjacent the front edge;

the front panel has an elongated rectangular shape and extends upwardly from a front edge to a top edge and laterally from one side panel to an opposite side panel;

the front panel comprises an outer front panel hingedly connected to an inner front panel other the top edge; and the front panel further comprises a front locking tab hingedly attached to the inner front panel and configured to fit through the front slot when the container is in the display configuration.

9. The shipping and display container of claim 8 wherein: each side panel has a locking tab that extends laterally inward from a side outer panel and is located between the outer front panel and the inner front panel.

10. The shipping and display container of claim 9 wherein:

the back panel includes an upwardly facing tab defined by a die cut; and the header free edge is inserted into the curved die cut and behind the upwardly facing tab when the container is in the display configuration.

11. A shipping and display container comprising:

a tray comprising a bottom panel, two side panels, a front panel and a back panel, each side panel comprising a side outer panel hingedly attached to the bottom panel along a bottom panel side edge and to a side inner panel along a tray side panel top edge, each side inner panel comprising a downwardly extending locking tab; and a lid comprising a top, two side panels, a front panel and a rear panel, the top defining at least two slots; wherein the container can be reconfigured from a box-like shipper configuration in which the lid covers the tray side panels, the tray front panel and the tray back panel, to a retail display configuration in which the tray bottom panel rests on the lid top and in which each locking tab is inserted into one of the slots to secure the tray to the lid.

12. The shipping and display container of claim 11 wherein:

the tray back panel extends upwardly from a rear edge of the tray bottom panel to a back panel top edge and laterally from a back panel side edge to an opposite back panel side edge;

the tray further comprises a side middle panel hingedly attached to the back panel along each of the back panel side edges; and each side middle panel is sandwiched between a side outer panel and a side inner panel.

* * * * *